United States Patent [19]

Yamakami et al.

[11] 4,442,883

[45] Apr. 17, 1984

[54] ROLL FOR CONTINUOUS CASTING

[75] Inventors: Yoshiaki Yamakami, Toyonaka; Arata Yoshimitsu, Katano, both of Japan

[73] Assignee: Kubota Ltd., Osaka, Japan

[21] Appl. No.: 356,529

[22] Filed: Mar. 9, 1982

[30] Foreign Application Priority Data

Apr. 13, 1981 [JP] Japan ..... 56-53717[U]

[51] Int. Cl.[3] ..... B22D 11/128

[52] U.S. Cl. ..... 164/448; 164/442

[58] Field of Search ..... 164/448, 447, 442, 441; 29/447, 129.5, 132

[56] References Cited

FOREIGN PATENT DOCUMENTS 51-48117 4/1976 Japan .

51-48118 4/1976 Japan .

55-111660 8/1980 Japan .

*Primary Examiner*—Kuang Y. Lin

*Attorney, Agent, or Firm*—Oblon, Fisher, Spivak, McClelland & Maier

[57] ABSTRACT

A continuous casting roll comprises a roll body having a cooling water bore coaxially therewith, and a sleeve fitted around the roll body and having one end fixed to the roll body and the other end as a free end. The roll body has a trunk portion and a shaft portion at each end of the trunk portion. A plurality of cooling water channels provided between the trunk portion and the sleeve extend in parallel axially thereof and have opposite ends in communication with the water bore. The sleeve is fitted around the roll body by a shrink fit the interference of which decreases steadily from the fixed end toward the free end to permit free thermal deformation of the sleeve toward the free end.

10 Claims, 10 Drawing Figures

ROLL FOR CONTINUOUS CASTING

BACKGROUND OF THE INVENTION

1. Field of the Invention

The present invention relates to improvements in rolls for continuous casting.

2. Description of the Prior Art

Continuous casting rolls comprise a roll body and a sleeve covering the roll body. The roll body has a shaft portion at each end of its trunk portion. In accordance with the method of cooling with water and the internal construction, these rolls are classified into the sleeve type, roll end type, arbor sleeve type, etc. as shown in FIGS. 7 to 9. The rolls of any of these types, however, involve the following problems in respect of durability, etc.

The roll of the sleeve type shown in FIG. 7 comprises a roll body 1 and a sleeve 2 covering the trunk portion 1*a* of the roll body and fixed at one end to the roll body 1 by a weld 3. A seal ring 5 for preventing leakage of water is fastened to the other end 4 of the sleeve by screws 6. A helical cooling water channel 7 formed in the peripheral surface of the trunk portion 1*a* communicates, through passages 8, 8*a*, with cooling water bores 9, 9*a* extending through the opposite ends of the roll body 1 coaxially therewith. Cooling water is supplied through the bore 9, passed through the passage 8, helical channel 7 and passage 8*a* and discharged from the bore 9*a*.

With this roll, the sleeve 2 is cooled directly with the water flowing through the helical channel 7 and therefore has relatively high resistance to the heat to which it is subjected during continuous casting. However, when the sleeve 2 is fitted to the trunk portion 1*a* of the roll body 1 tightly, the projections defining the helical channel 7 join with the sleeve 2 firmly to hinder axial free thermal expansion or deformation of the sleeve 2. Thus the sleeve is prevented from free thermal expansion when coming into contact with hot slabs. As a result, the sleeve undergoes plastic deformation and becomes susceptible to cracking. It is therefore impossible to fit the sleeve 2 to the trunk portion 1*a* tightly. On the other hand, if the sleeve 2 is fitted to the trunk portion 1*a* loosely, the sleeve separates from the projections on the roll trunk portion 1*a* when expanding during continuous casting, with the result that the load is supported by the sleeve 2 only. The sleeve 2 will then fracture relatively early, permitting the cooling water to jet out.

The roll end type shown in FIG. 8 is similar to the sleeve type in construction. The trunk portion 1*a* of its roll body 1 comprises a hollow pipe 11 and end plates 12, 12*a* at the opposite ends of the pipe 11. The end plate 12*a* is fixed to the large-diameter end of a shaft portion 1*b*. The opposite ends of a sleeve 2 are secured to the roll body 1 by welds 3, 3.

Accordingly the roll has the same drawback as the sleeve type roll; the free thermal expansion of the sleeve 2 is extremely inhibited. Additionally the trunk portion of the roll body involves problems in respect of strength and is liable to fracture early.

FIG. 9 shows an arbor sleeve type roll which comprises a roll body 1 and a sleeve 2 covering the trunk portion 1*a* of the body and fixed at its one end to the roll body 1 with a weld 3, so that the sleeve 2 can be tightly fitted around the trunk portion 1*a* by a shrink fit. However, since a cooling water channel 13 extends through the roll body 1 coaxially therewith, it is impossible to cool the sleeve 2 sufficiently only with the cooling water flowing through the channel 13. When external cooling water is not used, the longitudinally middle portion of the sleeve 2 is heated to a very high temperature and becomes softened and worn markedly. Although the sleeve tends to stretch toward its free end 4 owing to thermal expansion at high temperatures, the sleeve which is tightly fitted to the roll body as stated above is restrained and is unable to stretch fully. Consequently the sleeve bulges or cracks at the middle portion, rendering the roll unserviceable in a short period of time.

The product prepared by a continuous casting process is thereafter fed to a rolling process, in which it is reheated to a specific temperature and then rolled. If it is possible to minimize the drop of the temperature in the continuous casting process and to feed the casting to the rolling process as maintained at a high temperature, the combination of the casting process and the rolling process thus connected thereto directly will achieve great savings in energy. To realize this, there is the need to reduce the amount of water used for external cooling in the continuous casting process, but the casting roll will then be subjected to a greater thermal influence. The conventional rolls described above are in no way usable for fulfilling the above object because the foregoing drawbacks become more pronounced under such conditions.

SUMMARY OF THE INVENTION

The present invention provides a roll comprising a roll body and a sleeve covering the roll body, the roll body having a trunk portion and a shaft portion at each end of the trunk portion. The roll has a plurality of cooling water channels formed between the trunk portion and the sleeve and extending in parallel over at least ½ the length of the sleeve. The sleeve has one end fixed to the roll body and the other end as a free end. The sleeve is fitted around the roll body by a shrink fit with interference values of 0.07/1000 to 3.70/1000 on one side thereof toward the fixed end and 0 to 1.50/1000 on the other side thereof toward the free end, based on the outside diameter of the trunk portion. The interference value of the shrink fit on the side toward the free end within the foregoing range is smaller than the interference value on the side toward the fixed end at all times to permit the sleeve to thermally deform freely toward the free end.

DETAILED DESCRIPTION OF THE INVENTION

Figure 1:
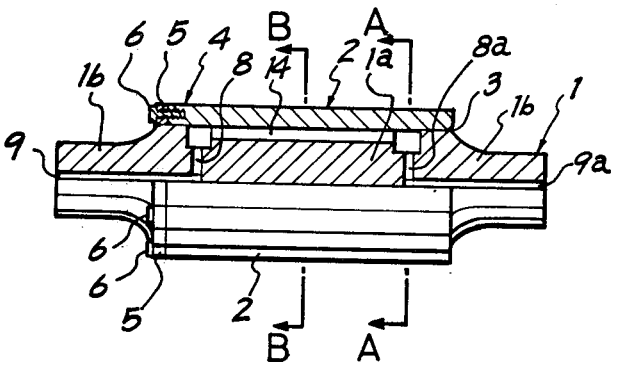
FIG. 1 is a side elevation partly broken away and schematically showing an embodiment of the roll of the invention.
Figure 2:
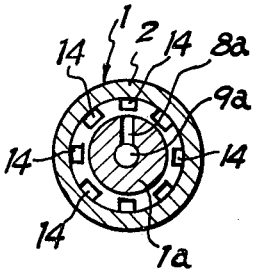
FIG. 2 is a diagram in section taken along the line A—A in FIG. 1.
Figure 3:
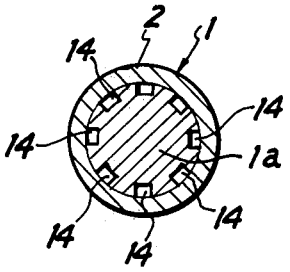
FIG. 3 is a diagram in section taken along the line B—B in FIG. 1.

FIG. 1 shows a roll comprising a roll body 1 and a sleeve 2 covering the roll body 1. The roll body 1 includes a trunk portion 1*a* and a shaft portion 1*b* at each end of the trunk portion 1*a*. A plurality of cooling water channels 14 are formed in the peripheral surface of the trunk portion 1*a*, extend in parallel axially thereof and are arranged at a suitable spacing. The opposite ends of the channels 14 communicate, through passages 8, 8*a*, with cooling water bores 9, 9*a* respectively which bores are formed in the roll body 1 coaxially therewith. The sleeve 2 has one end secured to the roll body 1 with a weld 3 and the other end as a free end 4. A seal ring 5 for preventing leakage of water is fastened to the free end 4 by screws 6. The free end is such that the sleeve is longitudinally stretchable or contractable at this end when the sleeve undergoes thermal expansion or contraction. The axial length of the cooling water channels 14 formed in the trunk portion 1*a* of the roll body 1 is at least ½ the length of the sleeve 2 in order to produce a sufficient cooling effect on the sleeve 2 with the cooling water through the channels, to assure a uniform temperature distribution longitudinally of the sleeve and to facilitate the movement of the sleeve due to expansion and contraction thereof. However, since the opposite end portions of the sleeve usually will not be thermally influenced by slabs directly, the channels need not extend to the sleeve ends, so that the length of the channels may be up to 4/5 the length of the sleeve.

The sleeve 2 is attached to the trunk portion 1*a* by a shrink fit with an interference which increases toward the fixed end of the sleeve to tightly fix the sleeve to the trunk portion, while the interference of the shrink fit is made smaller toward the free end provided that the backlash of the sleeve is avoidable to render the sleeve elastically movable longitudinally thereof with ease upon thermal expansion or contraction. More specifically, the sleeve 2 is fitted around the trunk portion 1*a* of the roll body 1 by a shrink fit with interference values of 0.07/1000 to 3.70/1000 on one side thereof toward the fixed end and 0 to 1.50/1000 on the other side thereof toward the free end, based on the outside diameter of the trunk portion 1*a*. The interference value of the shrink fit on the side toward the free end within the above range is smaller than the interference value on the side toward the fixed end at all times to enable the sleeve to thermally deform freely axially thereof. The shrink fit interference is made to vary linearly from the fixed end toward the free end.

With the roll of this invention in which the cooling water channel 14 between the trunk portion 1*a* and the sleeve 2 extend in parallel axially thereof, the sleeve can be tightly fitted to the roll body in intimate contact therewith with reduced backlash, unlike the conventional rolls of the sleeve type. Accordingly the pressure exerted during continuous casting is supported by the assembly of the sleeve and the roll body. This reduces the proportion of the load to be supported by the sleeve and renders the sleeve less susceptible to fracture or like damage.

The sleeve of the invention, unlike that of the conventional arbor sleeve type, is cooled directly with water and therefore involves only a greatly reduced likelihood of softening and abrasion. Furthermore, the cooling water channels 14 extend in parallel longitudinally of the sleeve, and the shrink fit of the sleeve to the roll body 1 is adapted to permit the elastic movement of the sleeve with greater freedom toward its free end as already described. This facilitates longitudinal expansion and contraction of the sleeve, i.e. thermal expansion during continuous casting and contraction while the sleeve is out of operation. Further because the sleeve is adapted to have a uniform temperature distribution longitudinally thereof as already stated, the sleeve is less prone to bulging or like deformation and cracking at its middle portion.

Figure 4:
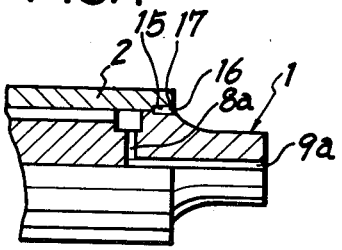
FIG. 4 is a fragmentary diagram in section showing a sleeve as attached to a roll body in a different mode.
Figure 5:
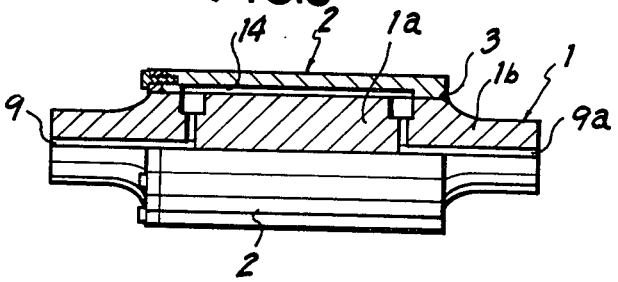
FIG. 5 is a side elevation partly broken away and schematically showing another embodiment of the invention having cooling water channels formed in the inner surface of a sleeve.
Figure 4A:
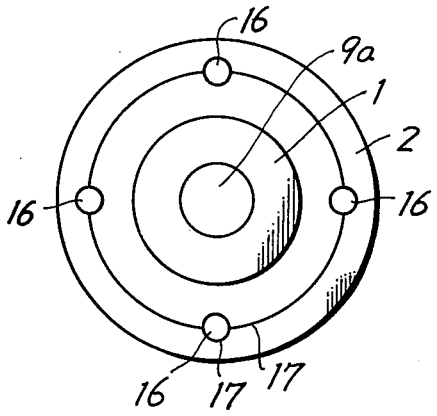
FIG. 4A is a side elevation view of FIG. 4.
Figure 10:
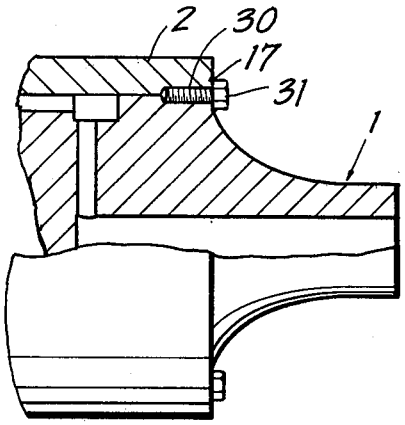
FIG. 10 is a fragmentary diagram in section showing a sleeve as attached to a roll body in a different embodiment.

While the cooling water channels 14 are formed in the peripheral surface of the trunk portion 1*a* of the roll body 1 in the foregoing embodiment, the channels 14 may alternatively be formed in the inner surface of the sleeve 2 as seen in FIG. 5. While the sleeve 2 is fixed to the trunk portion 1*a* by welding according to the foregoing embodiments, the sleeve 2 may otherwise be fixed thereto by forming a suitable number of bores 15 at the junction between the sleeve 2 and the trunk portion 1*a*, fitting fastening pins 16 thereinto and welding the junction as at 17 to form a seal to completely prevent leakage of water as shown in FIGS. 4 and 4A. Bores 15 and fastening pins 16 may be respectively replaced by threaded bores 20 and screws 31, as shown in FIG. 10.

Figure 6:
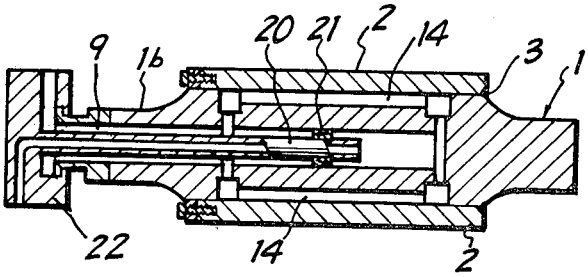
FIG. 6 is a sectional view schematically showing another embodiment of the invention.
Figure 7:
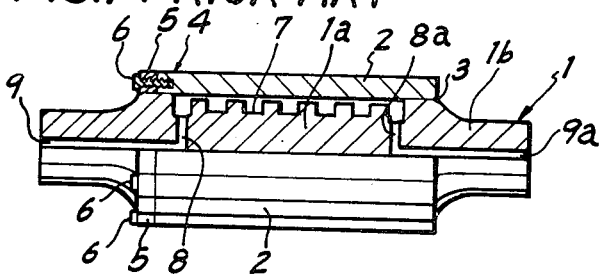
FIG.7 PRIOR ART
FIGS. 7 to 9 are side elevations partly broken away and schematically showing conventional rolls.
Figure 8:
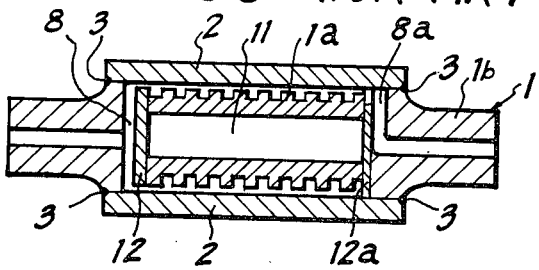
FIG.8 PRIOR ART
Figure 9:
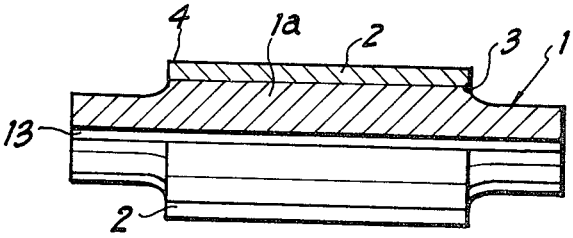
FIG.9 PRIOR ART

Instead of forming the cooling water bores 9, 9*a* through the opposite ends of the shaft portions 1*b* coaxially with the roll body 1 as already stated to render te body open at its opposite ends, a water bore 9 may be formed through only one shaft portion 1*b* to render the body open at one end as seen in FIG. 6. With this type of roll, a packing 21 is provided in the cooling water bore 9 to partition the bore 9 into front and rear portions. A pipe 20 having a rotary joint 22 at one end is inserted through the packing 21. Cooling water is supplied to the bore 9 through the rotary joint 22, passed through the channels 14 and pipe 20 and discharged from the rotary joint 22.

Rolls of this invention (comprising a roll body of Cr-Mo steel and a sleeve of 13% Cr steel measuring 40 mm in wall thickness and 350 mm in outside diameter) and conventional sleeve type rolls made from the same materials in the same dimensions as the former were tested under the same conditions. At a water pressure of 5.0 kg/cm$^2$ and at a water flow rate of 50 liters/min, leaks of water occurred on the 15th day in some rolls of the latter type. Four months later, the sleeve type rolls developed cracks up to 3 mm in the middle portion of the sleeve, whereas none of such accidents occurred to the rolls of this invention.

As described above, the roll of this invention is not prone to cracking or wear, less likely to permit leakage of water and outstanding in durability. The roll is very resistant to high temperatures, fully usable in the absence of external cooling water, therefore capable of maintaining continuously cast products at a high temperature and is usable for connecting the continuous casting process directly to a rolling process.

The roll of this invention is useful as a pinch roll or guide roll for continuous casting and is of course suited for conveying hot castings and hot steel plates.

The scope of the present invention is not limited to the foregoing description, but various modifications may be made by those skilled in the art without departing from the spirit of the invention. Such modifications are therefore included within the scope of the invention.

What is claimed is:

1. A roll for continuous casting comprising a roll body having a cooling water bore coaxially therewith, and a sleeve fitted around the roll body and having one end fixed to the roll body and the other end as a free end, the roll body having a trunk portion and a shaft portion at each end of the trunk portion, a plurality of cooling water channels being provided between the trunk portion and the sleeve and extending in parallel over at least ½ the length of the sleeve axially thereof, the water channels having opposite ends in communication with the cooling water bore, the sleeve being fitted around the roll body by a shrink fit with interference values of 0.07/1000 to 3.70/1000 on one side thereof toward the fixed end and 0 to 1.50/1000 on the other side thereof toward the free end based on the outside diameter of the trunk portion, the interference value on the side toward the free end within said range being smaller than the interference value on the side toward the fixed end at all times to permit free thermal deformation of the sleeve toward the free end.

2. A continuous casting roll as defined in claim 1 wherein the water channels are formed in the peripheral surface of the roll body.

3. A continuous casting roll as defined in claim 1 wherein the water channels are formed in the inner peripheral surface of the sleeve.

4. A continuous casting roll as defined in claim 1 wherein the water bore is formed in the shaft portion at each end of the trunk portion.

5. A continuous casting roll as defined in claim 1 wherein the water bore is formed in the shaft portion only at one end of the trunk portion.

6. A continuous casting roll as defined in claim 1 wherein said one end of the sleeve is fixed to the roll body by welding.

7. A continuous casting roll as defined in claim 1 wherein said one end of the sleeve is fixed to the roll body by forming at least one threaded bore at a junction between the sleeve and the trunk portion, fitting a screw thereinto and welding the said junction to form a seal.

8. A continuous casting roll as defined in claim 1 wherein the free end of the sleeve is provided with a ring for preventing leakage of water.

9. A continuous casting roll as defined in claim 8 wherein the ring is fastened to the sleeve by screws.

10. A continuous casting roll as defined in claim 1 wherein said one end of the sleeve is fixed to the roll body by forming at least one bore at a junction between the sleeve and the trunk portion, fitting a fastening pin thereinto and welding said junction to form a seal.

* * * * *